United States Patent [19]

McNully

[11] 4,338,977

[45] Jul. 13, 1982

[54] MANUAL TOOL FOR STRETCHING WIRE HAVING DIVERGING HANDLES

[76] Inventor: Joseph B. McNully, Rte. 4, Box 393, Seminole, Okla. 74868

[21] Appl. No.: 168,131

[22] Filed: Jul. 14, 1980

[51] Int. Cl.[3] ..... B21F 25/00

[52] U.S. Cl. ..... 140/70; 24/71.3; 140/123.5; 254/243

[58] Field of Search ..... 140/102, 102.5, 123.5, 140/124, 69, 70; 24/71.1, 71.2, 71.3, 68 B; 254/199, 213, 221, 243

[56] References Cited

U.S. PATENT DOCUMENTS

| | | | |
|---|---|---|---|
| 1,044,551 | 11/1912 | Lynch | 140/102.5 X |
| 1,274,736 | 8/1918 | Margeson | 140/123.5 X |
| 1,303,788 | 5/1919 | Gannon . | |
| 2,177,562 | 10/1939 | Eggink | 140/123.5 |
| 2,248,788 | 7/1941 | Seavex | 140/123.5 |
| 2,261,413 | 11/1941 | Robertson . | |
| 2,457,382 | 12/1948 | Koch | 140/123.5 |
| 2,552,003 | 5/1951 | Edwards | 140/123.5 |
| 3,006,385 | 10/1961 | Whitmore | 140/106 |

FOREIGN PATENT DOCUMENTS

| | | | |
|---|---|---|---|
| 232511 | 4/1925 | United Kingdom | 254/199 |

*Primary Examiner*—Gil Weidenfeld
*Assistant Examiner*—Fred A. Silverberg
*Attorney, Agent, or Firm*—Burns, Doane, Swecker & Mathis

[57] ABSTRACT

The present invention relates to a method and apparatus for stretching wire. The apparatus comprises a pair of elongated handles attached to a connecting element. A cylindrical member having an open-sided slot therein is secured to the connecting element. In operation, the wire to be stretched is placed in the slot in the cylindrical member and the cylindrical member is placed with its outer peripheral surface against a side of the fence post remote from a preceding fence post. The operator of the tool then rotates the handles in a manner rotating the cylindrical member about its longitudinal axis to stretch and wrap the wire about the cylindrical member. At the same time, the cylindrical member "rides" upwardly or downwardly along the fence post against which it is placed. In this way, a single operator can both stretch the wire and attach the wire to the fence post.

8 Claims, 4 Drawing Figures

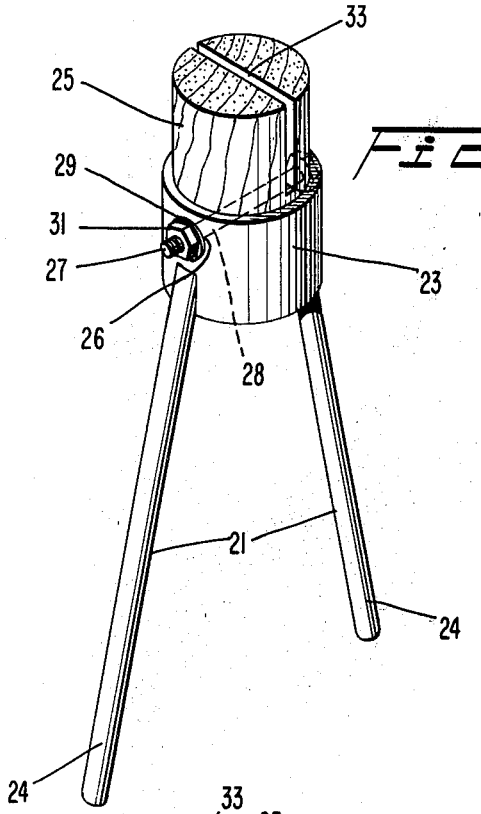
Fig. 1
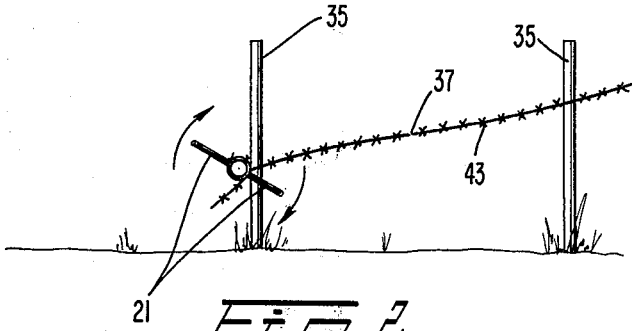
Fig. 2
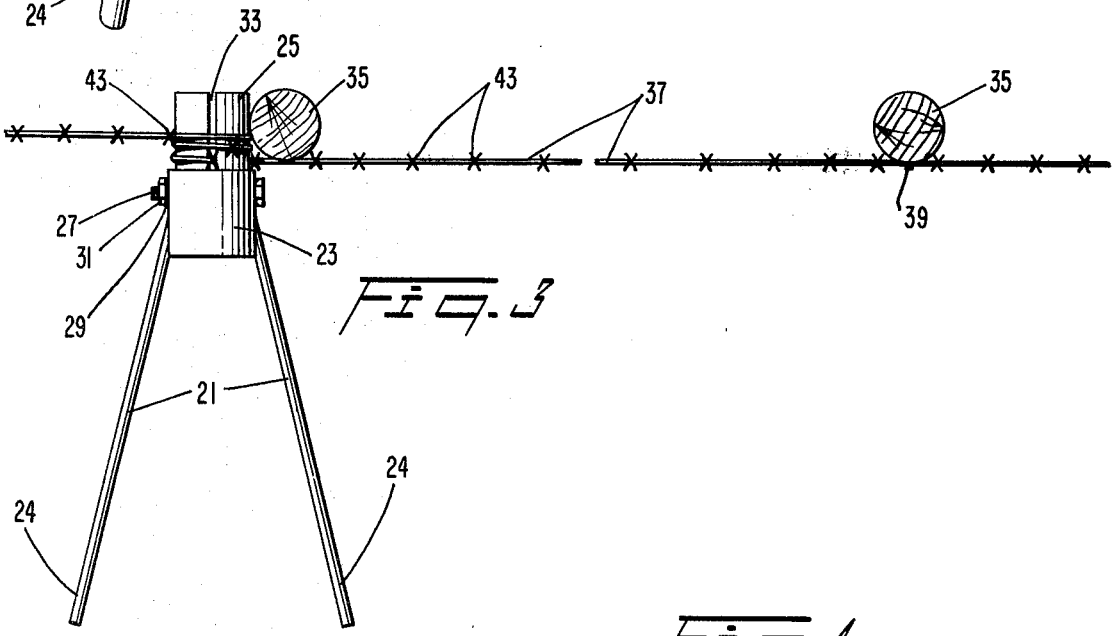
Fig. 3
Fig. 4
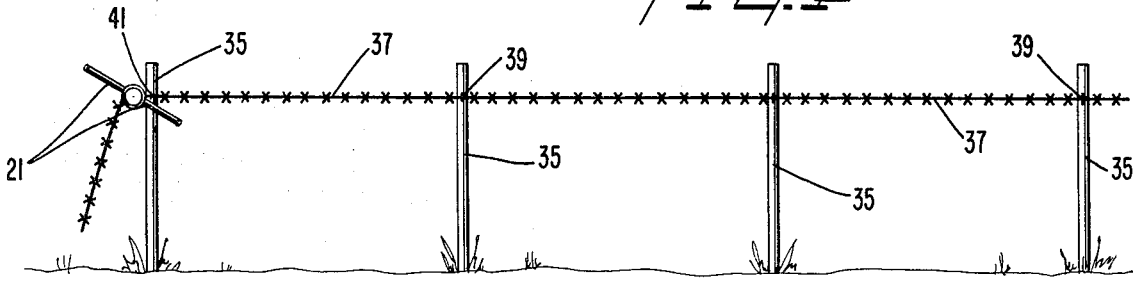

MANUAL TOOL FOR STRETCHING WIRE HAVING DIVERGING HANDLES

BACKGROUND AND SUMMARY OF THE PRESENT INVENTION

The present invention relates to a method and apparatus for stretching and tensioning wire, particularly barbed wire, along fence posts.

Various methods and apparatus have been proposed to stretch wire along fence posts prior to securing the wire to the individual fence posts. These methods and apparatus have met with limited success. Often the apparatus is cumbersome. Also, many of the prior devices have required at least two people in order to successfully attach the wire to the fence post while maintaining tension on the wire.

One known method for stretching wire along fence posts is to attach an end of the wire to a bumper or other part of a vehicle and drive the vehicle along the fence until the wire is properly stretched. However, this requires the use of a vehicle and also requires that the operator get in and out of the vehicle to attach the wire to the fence posts.

U.S. Pat. No. 2,552,003 issued on May 8, 1951 to Edwards discloses a wire stretcher in which a wire is stretched by rotating the wire around a shaft. A free end of the wire is inserted into an opening in the shaft. The free end of the wire is bent around the shaft to hold it in place and each succeeding turn of wire on the shaft overlies the free end to prevent it from slipping out of the opening. A device of this type requires one person to hold the wire stretcher and the taut wire while a second person secures the wire to a fence post.

Other known wire stretching devices are disclosed in U.S. Pat. Nos. 1,303,788; 2,248,788; 2,261,413; 2,457,382; and 3,006,395. None of these devices is simple to operate and manufacture and each generally requires the use of more than one person to stretch and attach the wire to a fence post.

Therefore, it is an object of the present invention to provide a method and apparatus for stretching wire which is simple in construction and operation and is effective to stretch the wire.

A further object of the present invention is to provide a method and apparatus which permits a single person to stretch a wire and attach the wire to a fence post while maintaining the wire in tension.

A still further object of the present invention is to provide an apparatus which is simple to manufacture and securely holds the wire, particularly barbed wire, which is to be stretched.

These and other objects of the present invention are accomplished by an apparatus which comprises elongated handles which are rigidly attached to a connecting element. An elongated member is secured to the connecting element and has a continuously curved outer peripheral surface along at least a portion of its length. An open sided slot is provided along a portion of the length of the elongated member which slot extends from one end of the elongated member. The elongated member is secured to the connecting element such that the handles generally extend along a longitudinal axis of the member.

In a preferred embodiment, the elongated member is cylindrical in shape with the slot extending along a diameter of the cylindrical member. Further, the cylindrical member is wood so that barbs on a barbed wire will slightly penetrate the cylindrical member to prevent slippage of the wire during stretching.

In operation, a first section of a wire to be stretched is attached to a first post in a line of preexisting fence posts. The wire is then unrolled along the fence posts until the wire extends beyond the last fence post in the line. A second section of the wire is then inserted into the slot in the elongated member of the apparatus according to the present invention and the outer peripheral surface of the elongated member is placed against the last fence post on a side of the last post opposite the side facing the first fence post with the handles extending generally perpendicularly to the last fence post.

The handles are then rotated in a clockwise or counter-clockwise direction to stretch the wire. The rotation of the handles causes the elongated member to "ride", or roll, up or down the last fence post depending upon the direction of rotation of the handles. When the desired height and tension of the wire has been obtained, the stretcher of the present invention is held against counter-rotation by placing one handle against a portion of the operator's body. In this way, the hands of the operator are free to staple a third section of the wire to the last fence post at the appropriate location. The wire is then unrolled from the elongated member by rotating the handles in a reverse direction. The stretched wire is subsequently attached to the intermediate fence posts.

BRIEF DESCRIPTION OF THE DRAWINGS

A preferred embodiment of a wire stretching method and apparatus according to the present invention will be described with reference to the accompanying drawings wherein like members bear like reference numerals and wherein:

FIG. 1 is a perspective view of a wire stretching apparatus according to the present invention;

FIG. 2 is a perspective view of a portion of a line of fence posts with the apparatus of the present invention in place to initiate stretching;

FIG. 3 is a top view of the fence posts and the wire stretching apparatus of FIG. 2; and FIG. 4 is a view similar to FIG. 2 at the completion of the stretching operation.

DETAILED DESCRIPTION OF THE PREFERRED EMBODIMENT

With reference to FIG. 1, the tool of the present invention includes a pair of elongated arms or handles 21 which are rigidly secured by any suitable means, e.g., welding, to a connecting element 23. The handles are preferably made of a light metal such as aluminum in order to save weight. In a preferred embodiment, the handles 21 are two inch tubular aluminum rods with an overall length of approximately three feet. In addition, the handles 21 diverge rearwardly, i.e., extend at an angle from the connecting element 23 in order to provide wider spacing between the handles at a gripping end 24 of the handles 21. It may also be desirable to employ a rubber grip or other suitable grip near the ends 24 of the handles 21 to limit slippage of the hands of the operator when using the tool.

The connecting element 23 is preferably made of metal for added strength and is provided with a forwardly open cylindrical opening or socket which receives an elongated member or nose piece 25. The nose piece 25 may be secured to the connecting element 23 by any suitable fastener. In a preferred embodiment, the nose piece 25 is held in place by a releasable bolt 27 which passes through a bore 26 through the connecting element 23 and an aligned bore 28 in the nose piece 25. The bolt 27 is secured by a lock washer 29 and a nut 31. It is also contemplated that the connecting element 23 could be eliminated and the handles 21 could be secured directly to the nose piece 25 by any suitable arrangement.

The nose piece 25 is provided with an open-sided slot 33 which is sufficiently wide to permit a wire to be placed therein. The slot 33 is arranged through a central section of a first end of the nose piece 25 and extends along a longitudinal axis of the nose piece 25 from the first end along a portion of the length of the nose piece 25. Preferably, the slot 33 extends to approximately an upper edge 34 of the connecting element 23 when the nose piece 25 is inserted therein.

In a preferred embodiment, the nose piece 25 is a cylindrical member. However the nose piece 25 could be of any suitable shape as long as the outer peripheral surface of the nose piece which surface extends outside of the connecting element 23 is continuously curved for reasons explained below. For example, the nose piece could also be constructed in the shape of a truncated cone, or the portion of the nose piece 25 within the connecting element 23 could be square while the remaining portion of the nose piece 25 could be cylindrical.

The nose piece may be formed of any material. For use with barbed wire the nose piece 25 is preferably formed of a material, such as wood, which is soft enough to be readily gripped by the barbs of the barbed wire. By contructing the nose piece 25 of wood, the barbs on the wire can partially penetrate the wood and thereby hold the wire securely to the nose piece 25 during stretching. It should also be noted that the nose piece 25 is easily replaced with a new wooden nose piece 25 by removing the bolt 27 at nominal cost if one nose piece should become worn from continual use. In one form of the present invention, the nose piece 25 is four inches in diameter and twelve inches long of which approximately six inches extend outwardly from the connecting element 23.

In operation, and referring to FIGS. 2–4, a plurality of fence posts 35 are arranged along the area to be bounded by a fence. A wire 37 has a first section 39 (FIG. 4) stapled to a first fence post at a desired height. The wire 37 is unrolled along the fence posts 35 until the wire extends beyond the last fence post. A second section of the wire is placed in the base of the slot 33 in the tool of the present invention. The curved outer peripheral surface of the nose piece 25 is placed against the side of the last fence post which is opposite from the side facing an adjacent fence post. In other words, the nose piece 25 is placed on the "downstream" side of the last fence post. The handles 21 are then rotated by the operator, in the illustrated embodiment, in a clockwise direction.

As the handles 21 are rotated in a manner rotating the nose piece 25 about its longitudinal axis, the wire 37 wraps around the nose piece 25 and the barbs 43 on the wire 37 slightly penetrate the nose piece 25. At the same time the nose piece 25 "rides", or rolls, smoothly upwardly on its curved outer surface along the last fence post. It should also be noted that the wire 37 is preferably wrapped around the portion of the nose piece 25 between the operator and the side of the last fence post facing the operator (FIG. 3). By wrapping the wire 37 close to the connecting element 23, contact between the curved outer peripheral surface of the nose piece 25 and the last fence post can be more easily maintained.

When the desired height and tautness of the wire 37 is achieved (FIG. 4), one of the handles 21 (preferably the handle to the left of the operator when the handles are rotated clockwise as illustrated) is rested against a shoulder or other bodily part of the operator to prevent counter-rotation of the device and consequent unwinding of the wire 37. By bracing one of the handles 21 on his shoulder, the operator is then free to staple a third section 41 of the wire 37 to the last fence post at the appropriate height.

After securely attaching the wire 37 to the last fence post the handles are rotated in a reverse direction to unwrap the wire 37 from the nose piece 25 and, thereafter, the operator proceeds to attach the wire 37 to the intermediate fence posts. It is apparent that if a wire is to be stretched along a lower portion of the fence posts 35 that the handles 21 may be rotated in a counter-clockwise direction to stretch the wire 37. In this case, the nose piece 25 "rises" downwardly along the last fence post.

As can be seen, the apparatus of the present invention permits a single operator to tightly stretch wire along a line of fence posts and attach the wire while it is still taut. The method of the present invention also facilitates stretching the wire since one of the fence posts is used as a brace for supporting the tool during stretching. In other words, the operator does not have to be strong enough to hold the wire tight by hand but merely must turn the handles of the tool of the present invention. The fence post against which the tool is placed holds the wire taut even if the operator needs to rest before the wire reaches the desired height.

By providing a smooth, continuously curved outer peripheral surface on the nose piece 25, the nose piece rides smoothly along the surface of the last fence post. Also, by using wood for the nose piece 25 the barbs 43 on the wire will slightly penetrate the wood and be securely held in the wood as the wire is wrapped. Therefore, there is little likelihood that the wire will unwrap and loosen during the stretching operation.

The principles and preferred embodiments of the present invention have been described in the foregoing specification. However, the invention which is intended to be protected is not to be construed as limited to the particular embodiments disclosed. The embodiments are to be regarded as illustrative rather than restrictive. Variations and changes may be made by others without departing from the spirit of the invention. Accordingly, it is expressly intended that all such variations and changes which fall within the spirit and scope of the present invention as defined in the appended claims be embraced thereby.

What is claimed is:

1. A tool for stretching wire during securement thereof to a post, the tool comprising:

handle means by which the tool may be manually held;

an elongated member having a continuously curved outer peripheral surface along at least a portion of the length of the member, said member having an open-sided longitudinal slot through a central section of the member for receiving a wire, said slot extending along a portion of the length of the member from a first end of the member;

connecting means for connecting a second end of the member of the handle means such that rotation of the handle means produces rotation of the member which rolls along a side of a post while wrapping and stretching wire received in the slot; and said handle means comprising two elongated rods, said rods being secured on opposite sides of said connecting means and diverging outwardly from the connecting means such that the distance between longitudinal axes of the rods increases.

2. The tool of claim 1 wherein the elongated member is a cylindrical member.

3. The tool of claim 2 wherein the connecting means comprises an element having a cylindrical opening for receiving the cylindrical member, the cylindrical member being releasably secured to the element by a bolt passing through the element and the cylindrical member.

4. The tool of claim 3 wherein the slot in the cylindrical member extends to an edge of the cylindrical opening when the cylindrical member is secured in the cylindrical opening.

5. The tool of claim 1 wherein the tool is for stretching barbed wire and wherein the member is of a material which is penetrable by barbs on the wire.

6. The tool of claim 5 wherein the member is wood.

7. The tool of claim 1 wherein the connecting means releasably secures the member to the handle means.

8. A tool for stretching barbed wire during securement thereof to a post, the tool comprising:

a handle including a pair of elongated arms diverging from forward ends thereof such that the distance between longitudinal axes of the arms increases;

an element connected to the forward ends of the arms, the element including a forwardly open cylindrical socket;

a cylindrical member mounted in the socket and projecting forwardly therefrom, the member including an open-sided slot extending rearwardly from a forward end of the member to receive barbed wire, said member being penetrable by barbs on the wire; and connecting means for releasably connecting the member to the element such that rotation of the arms produces rotation of the member along a longitudinal axis thereof so that the member rolls along a side of a post while wrapping and stretching wire received in the slot.

* * * * *